US007396004B2

(12) United States Patent
Kern

(10) Patent No.: US 7,396,004 B2
(45) Date of Patent: Jul. 8, 2008

(54) CLAMP BAR EXTENSION

(75) Inventor: John M. Kern, 2300 Commerce Dr., Fremont, OH (US) 43420

(73) Assignee: John M. Kern, Helena, OH (US)

( * ) Notice: Subject to any disclaimer, the term of this patent is extended or adjusted under 35 U.S.C. 154(b) by 0 days.

(21) Appl. No.: 11/519,596

(22) Filed: Sep. 12, 2006

(65) Prior Publication Data

US 2007/0057424 A1 Mar. 15, 2007

Related U.S. Application Data

(60) Provisional application No. 60/716,330, filed on Sep. 12, 2005.

(51) Int. Cl.
*B25B 1/00* (2006.01)

(52) U.S. Cl. ..... 269/6; 269/3

(58) Field of Classification Search ..... 269/6, 269/3, 95, 166–169, 147–148, 170
See application file for complete search history.

(56) References Cited

U.S. PATENT DOCUMENTS

| | | | | |
|---|---|---|---|---|
| 1,484,794 | A | 2/1924 | Moses | |
| 1,583,611 | A | 5/1926 | Seely | |
| 2,007,009 | A * | 7/1935 | Staples | 266/259 |
| 2,949,947 | A | 8/1960 | Story | |
| 3,521,686 | A | 7/1970 | Weinmann | |
| 4,735,389 | A | 4/1988 | Graham | |
| 4,926,722 | A | 5/1990 | Sorensen et al. | |
| 5,009,134 | A | 4/1991 | Sorensen et al. | |
| 5,022,137 | A | 6/1991 | Sorensen et al. | |
| 5,499,800 | A | 3/1996 | Albin | |
| 6,089,556 | A | 7/2000 | Whiteford | |
| 6,386,530 | B1 | 5/2002 | Marks | |
| 6,412,767 | B1 | 7/2002 | Beckmann et al. | |
| 6,530,565 | B1 | 3/2003 | Simpson | |
| 6,554,264 | B1 | 4/2003 | Alford | |
| 6,658,711 | B1 * | 12/2003 | Benson | 29/237 |
| 6,746,006 | B2 | 6/2004 | Thomas | |
| 2007/0057424 | A1 * | 3/2007 | Kern | 269/6 |

* cited by examiner

*Primary Examiner*—Lee D Wilson
(74) *Attorney, Agent, or Firm*—Fraser Clemens Martin & Miller LLC; Donald R. Fraser

(57) ABSTRACT

The present invention relates to bar clamps, and more specifically, to attachments for extending the length of such clamps and enabling such clamps to be adaptable to a wider array of clamping needs. The accessories include an extension bar, a coupling that attaches one end of the extension bar to the clamp primary bar locking the bars in longitudinal alignment, and a stop that attaches to the primary bar or extension for fixing the location of a clamp jaw along the bars.

12 Claims, 6 Drawing Sheets

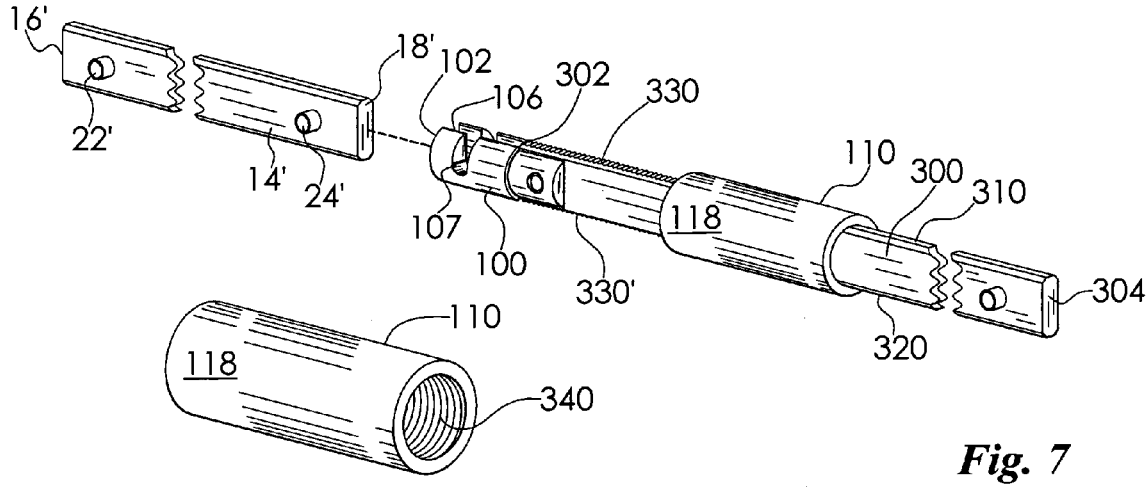
*Fig. 7*
*Fig. 7a*
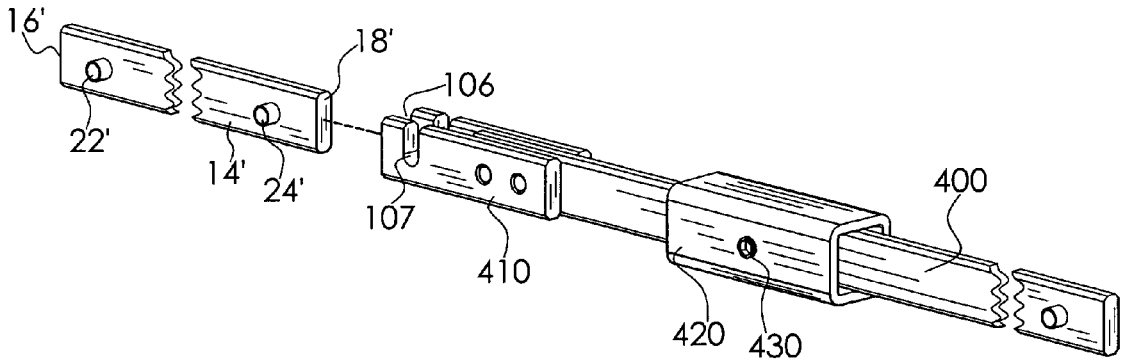
*Fig. 8*

CLAMP BAR EXTENSION

CROSS-REFERENCE TO RELATED APPLICATION

This application claims the benefit of U.S. Provisional Patent Application Ser. No. 60/716,330 filed on Sep. 12, 2005.

FIELD OF THE INVENTION

The present invention relates to bar clamps, and more specifically, to attachments for extending the length of such clamps.

BACKGROUND OF THE INVENTION

Bar clamps are well known for use in holding a work piece in a predetermined position. The known bar clamps typically comprise relatively moveable jaws attached to a bar. U.S. Pat. No. 4,926,722 to Sorensen and Gatzemeyer is exemplary of a bar clamp structure of the prior art.

Typically, bar clamps are employed to hold a number of objects together for gluing or other purposes to retain the objects in a fixed position for a certain period of time. The user may be required to employ multiple clamps of varying lengths to accommodate different objects of different dimensions.

While a movable jaw provides a variety of clamping positions along the length of the clamping bar, the finite length of the clamping bar limits the range of clamping positions available for each clamp. In many instances it may be necessary for the user to utilize multiple clamps of varying lengths to accommodate various objects in association with accomplishing a variety of clamping tasks.

U.S. Pat. No. 6,530,565 to Simpson illustrates and describes a bar clamp wherein the bar clamp uses a threaded fastener to lock an extension bar in proper alignment.

The current bar clamps are limited in the arrangement of the clamp jaws. Typically, one of the jaws is fixed at one end of the bar clamp. Thus, the possibility of adjustments is predetermined.

There is a need for improvements in bar clamps which would provide a movable jaw component and a fixed jaw component in conjunction with a variety of bar lengths to enable the securement of the fixed jaw along the length of the bar to allow for a bar clamp to be adapted to a wider variety of clamping needs than possible with the current designs.

SUMMARY OF THE INVENTION

Harmonious with the present invention, it is an object to produce an improved bar clamp extension for extending the working length of a bar clamp to a plurality of working lengths.

Another object of the present invention is to produce a stop for selectively adjusting the location of a jaw component along the length of a clamp bar.

Surprisingly, the above objects may be achieved by: an extension bar with an associated coupling adapted to join one end of the primary clamp bar to an end of an extension bar; and a pair of sleeves adapted to slide along the clamp bar and lock at a desired location along the length of the clamp bar with the fixed clamp held between the sleeves.

BRIEF DESCRIPTION OF THE DRAWINGS

The above, as well as other, objects and advantages of the invention will become readily apparent to those skilled in the art from reading the detailed description of an embodiment of the invention when considered in the light of the accompanying drawings, in which:

FIG. 7 is a perspective view of another embodiment of the bar clamp extension;

FIG. 7*a* is a perspective view of the bar clamp sleeve illustrated in FIG. 7;

FIG. 8 is a perspective view of still another embodiment of the bar clamp extension;

DETAILED DESCRIPTION OF THE PREFERRED EMBODIMENT OF THE INVENTION

Figure 1:
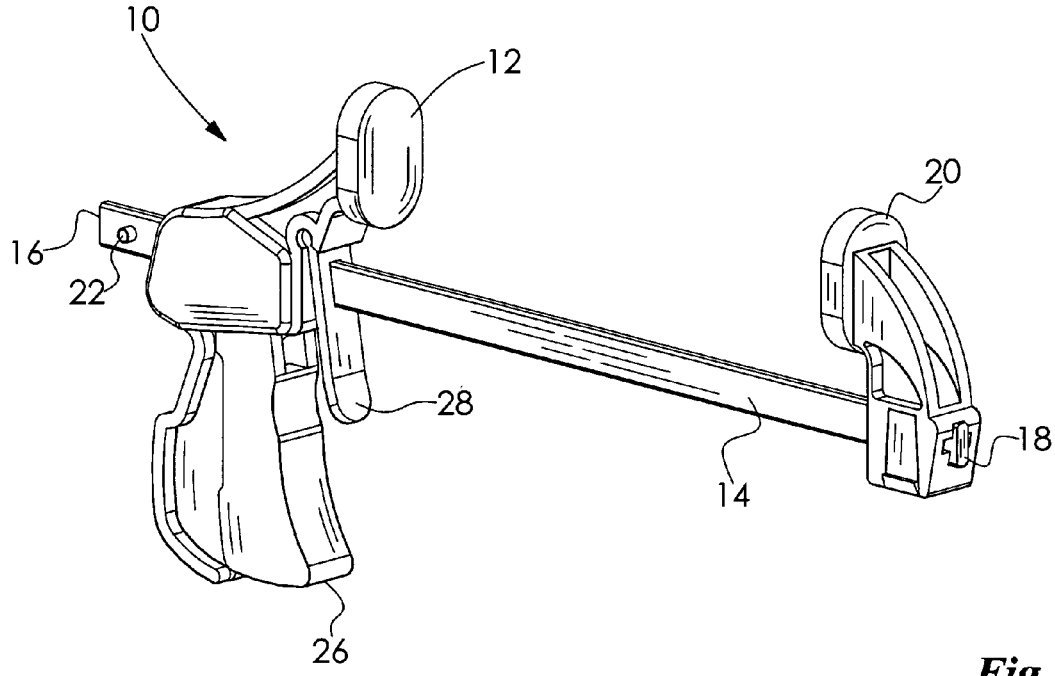
FIG. 1 is a perspective view of a prior art bar clamp.

Referring to the drawings and in particular to FIG. 1 there is illustrated a conventional pistol-grip bar clamp, generally indicated by reference numeral 10, which includes a pistol-grip jaw 12 moveably adjustable to a plurality of positions along a primary bar 14. The primary bar 14 is provided with a proximal end 16 and a distal end 18. A fixed jaw 20 is typically secured at the distal end 18 of the bar 14. The bar includes a proximal pin 22 and a distal pin 24 both of which extend transversely from the bar 14. The distal pin 24 releasably engages the fixed jaw 20. The moveable jaw 12 is slideably attached adjacent the proximal end 16 of the bar 14. A moveable jaw handle 26 is employed to advance the moveable jaw 12 along the bar 14 toward the distal end 18 and the fixed jaw 20.

In operation, a workpiece (not shown) is clamped between the jaws 12 and 20 by advancing the moveable jaw 12 along the bar 14 toward the fixed jaw 20 until a desired clamping force is applied to the workpiece. To open the clamp, a trigger 28 is typically manually moved in the direction of the proximal end 16 which releases the moveable jaw 12 allowing the jaw 12 to be moved along the bar 14 toward the proximal end 16.

Figure 2:
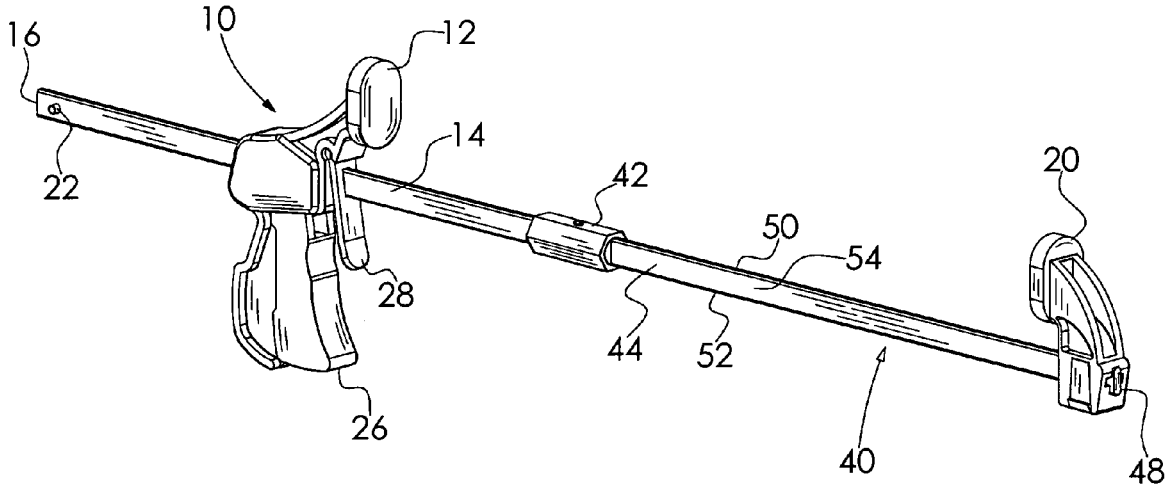
FIG. 2 is a perspective view of the bar clamp with an attached bar clamp extension embodying the features of the present invention.
Figure 3:
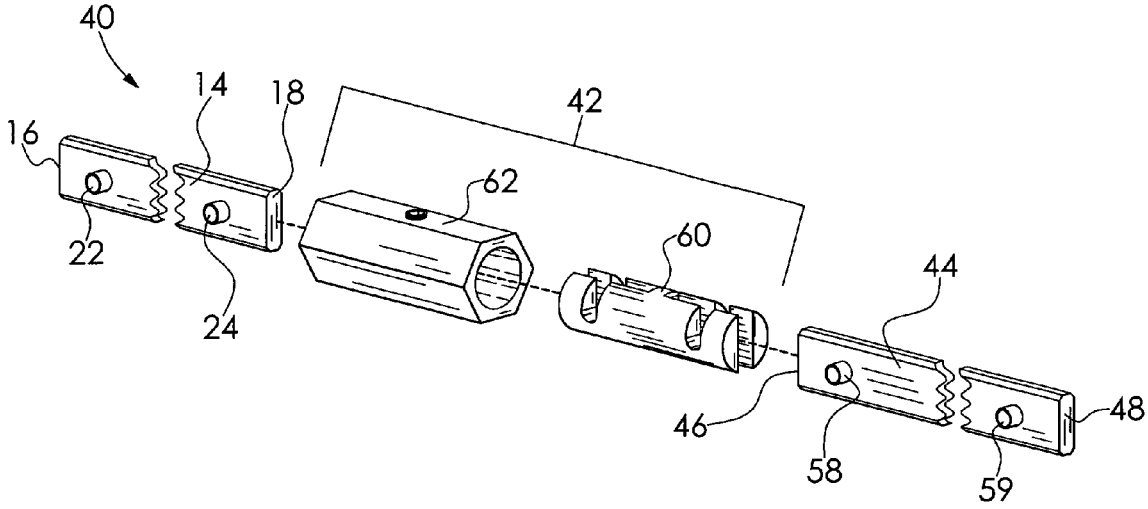
FIG. 3 is an exploded perspective view of the bar clamp extension illustrated in FIG. 2.

Referring to FIGS. 2 and 3, a bar clamp extension assembly, generally indicated by reference numeral 40, is illustrated. The assembly 40 is typically used with the pistol-grip bar clamp 10. The assembly 40 generally comprises a coupling 42 that releasably attaches to a primary bar 14 of the pistol-grip bar clamp 10 and an extension bar 44. The coupling 42 joins the bars 14 and 44 in longitudinal alignment extending the working length of a typical bar clamp.

The extension bar 44 is longitudinally extended with a proximal end 46 and a distal end 48. The extension bar 44 is rectangular in cross-section with an upper surface 50, a lower surface 52, and opposing spaced apart sides 54 and 56. A proximal pin 58 and a distal pin 59 extend transversely from the respective sides 54 and 56 of the bar 44. The coupling 42 joins the distal end 18 of the primary bar 14 to the proximal end 46 of the extension bar 44 in longitudinal alignment.

The coupling 42 includes two cooperating members; namely, a body 60 and a sleeve 62. The body 60 has opposed ends 64, 64' each of which include a longitudinal slot 66, 66' and transverse slots 67, 67' respectively. The longitudinal slots 66, 66' are adapted to receive the respective ends 18 and 46 of the bars 14 and 44 while the transverse slots 67, 67' are adapted to receive the respective pins 24 and 58 of the bars 14 and 44. The sleeve 62 in the illustrated embodiment is substantially equal in length to the length of the body 60. The sleeve 62 has opposing ends 68, 68' with an outer surface 72 and an inner surface 74. The sleeve 62 is adapted to receive the body 60. The sleeve includes a set screw 78 which may be tightened against the body 60 to hold the sleeve 62 in longitudinal alignment with the body 60 and to lock the bars 14 and 44 in longitudinal alignment.

Figure 4:
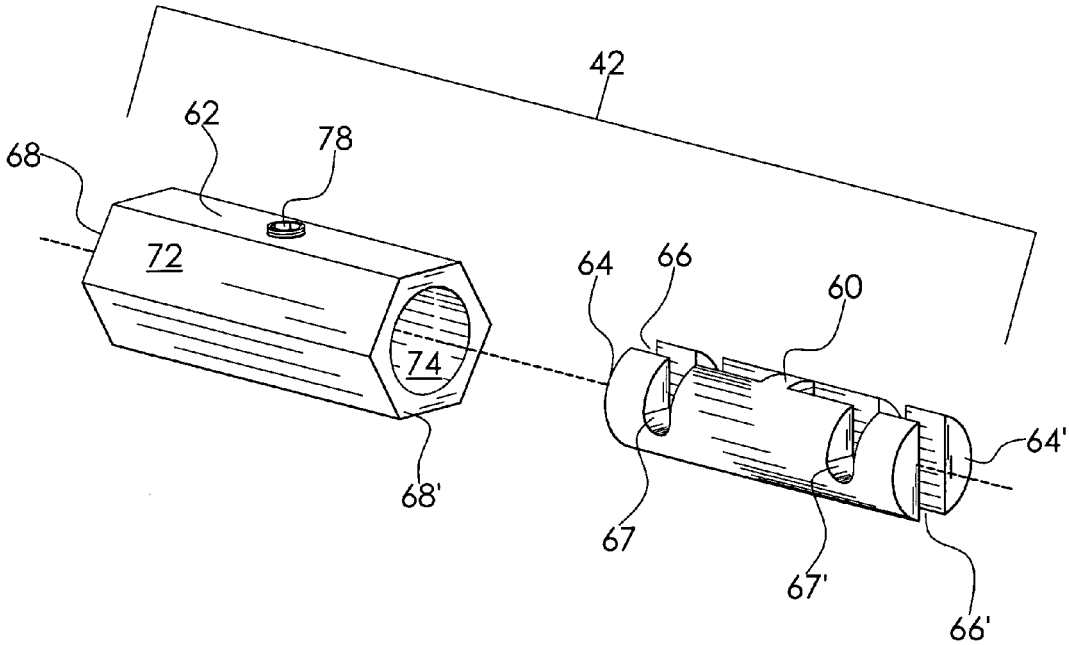
FIG. 4 is an exploded perspective view of the bar clamp coupling illustrated in FIGS. 2 and 3.

In FIGS. 5-8 illustrate alternative embodiments of the bar clamp extension illustrated in FIGS. 2-4. When similar components are utilized, prime reference numerals are used to indicate such components.

Figure 5:
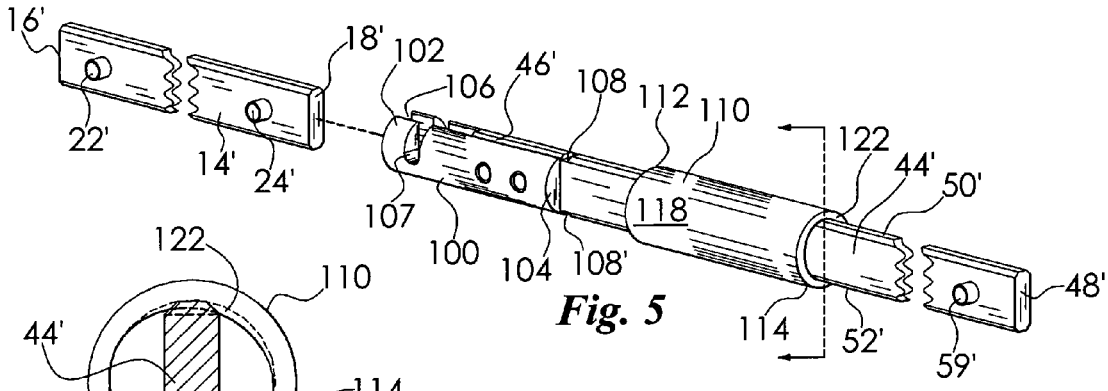
FIG. 5 is a perspective view of another embodiment of the bar clamp extension illustrated in FIGS. 2 to 4.
Figure 5A:
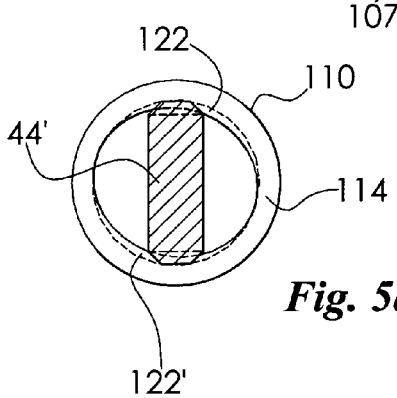
FIG. 5*a* is a transverse view of the bar clamp extension illustrated in FIG. 5.

FIG. 5 there is shown a coupling body 100 which is cylindrical and has a proximal end 102 with longitudinal slot 106 and transverse slot 107. The slots 106, 107 are adapted to receive the respective end 18' and pin 24' of the primary bar 14'. The body 100 has a distal end 104 affixed to the proximal end 46' of the extension bar 44'. The extension bar 44' has a notch 108, 108' formed in the respective upper surface 50' and lower surface 52'.

The sleeve 110 shown in FIGS. 5. and 5*a* is substantially equal in length to the body 100 and includes a proximal end 112 and a distal end 114. The sleeve 110 is hollow and has an outer surface 118 and an inner surface 120. The inner surface 120 is cylindrical and allows the sleeve 110 to receive the body 100 and to rotate about the longitudinal axis of the body 100.

The sleeve 110 includes a pair of opposing and spaced apart arcuate collars 122, 122' at the distal end 114. The collars 122, 122' depend from the inner surface 120 and extend radially inward. The collars 122, 122' provide a positive stop that limits the amount of rotation about the longitudinal axis of the bar 44'. Further, the collars 122, 122' provide a positive stop that prevents the sleeve distal end 114 from sliding past the body distal end 104.

When the end surfaces of the collars 122, 122' are in contact with the distal end 104, the sleeve 110 and body 100 are in horizontal alignment and the collars 122, 122' are aligned with the notches 108, 108' in the extension bar 44'. The notches 108, 108' receive the collars 122, 122' as the sleeve 110 is rotated about the longitudinal axis of the extension bar 44' which allows the sleeve 110 to rotate further about the longitudinal axis of the bar 44' when so positioned.

When the sleeve 110 and body 100 are in horizontal axial alignment, the sleeve 110 may be secured to the extension bar 44' by rotating the sleeve 110 with respect to the longitudinal axis of bar 44'. The sleeve 110 is rotated until the collars 122, 122' contact the notches 108, 108'. The contact friction between the collars 122, 122' and the notches 108, 108' secures the sleeve 110 to the extension bar 44' effectively locking the primary bar 14' and the extension bar 44' in longitudinal alignment.

Figure 6:
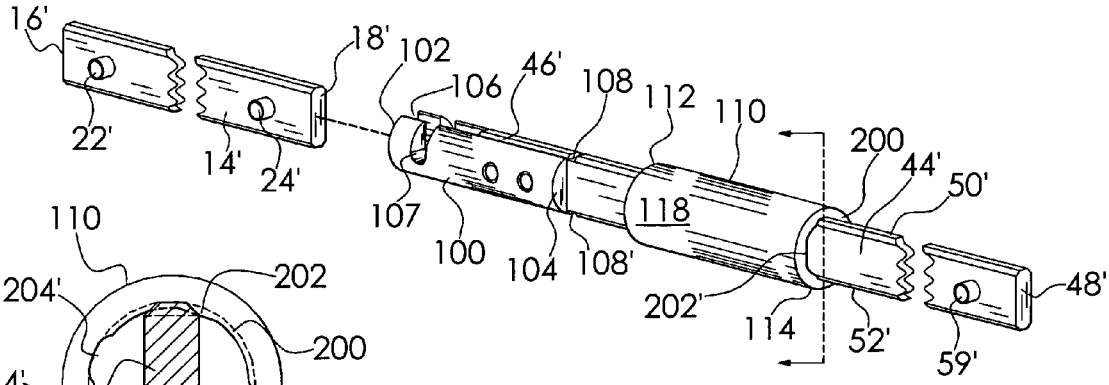
FIG. 6 is a perspective view of still another embodiment of the bar clamp extension.
Figure 6A:
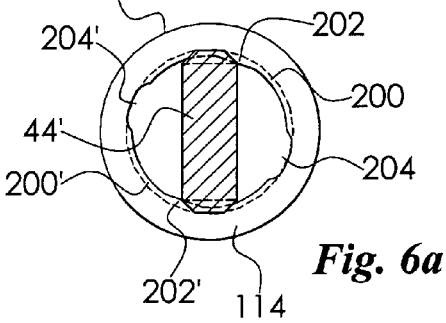
FIG. 6*a* is a transverse view of the bar clamp extension illustrated in FIG. 6.

FIGS. 6 and 6*a* illustrate an alternative embodiment of a coupling sleeve. The sleeve 110 is provided with a pair of opposing and spaced apart circular collars 200 and 200' at the distal end 114. Each collar includes a radial extension 202, 202' at the collar midpoint. The collars 200, 200' form opposing slots 204, 204' at the distal end 114 of the sleeve for receiving the extension bar 44'. The slots 204, 204' allow the sleeve 110 to slide longitudinally along the bar 44' while substantially preventing the sleeve 110 from rotating about the longitudinal axis of the bar 44'.

When the collars 200, 200' are in contact with the body distal end 104', the sleeve 110 and body 100 are in horizontal alignment and the collars 200, 200' are aligned with the notches 108, 108' in the extension bar 44'. The notches 108, 108' receive the collars 200, 200' as the sleeve 110 is rotated about the longitudinal axis of the bar 44' which allows the sleeve 110 to further rotate about the longitudinal axis of the bar 44' when so positioned. The sleeve 110 is secured to the bar 44' by rotating the sleeve 110 with respect to the longitudinal axis of the bar 44' until the collar extensions 202, 202' contact the notches 108, 108' in the bar 44'. The sleeve 110 is secured in place by contact friction between the extensions 200, 202' and the notches 108, 108'.

FIGS. 7 and 7*a* illustrate an alternative embodiment of an extension bar and coupling sleeve. An extension bar 300 has a proximal end 302 and a distal end 304. The extension bar 300 includes an upper surface 310 and a lower surface 320, each provided with a respective linear array of threaded teeth 330, 330'. The sleeve 110 is provided with internal threads 340 adapted to engage the respective threaded teeth 330, 330' to effectively lock the extension bar 300 in longitudinal alignment with the main bar 14'.

FIG. 8 illustrates an alternative embodiment of the coupling body and sleeve. A body 410 and sleeve 420 are rectangular in cross-section. The sleeve 420 is adapted to receive the body 410. The sleeve 420 includes a threaded set screw 430 that may be tightened against the body 410 to secure the sleeve 420 to the body 410 to effectively lock the extension bar 400 in longitudinal alignment with the main bar 14'.

Figure 9:
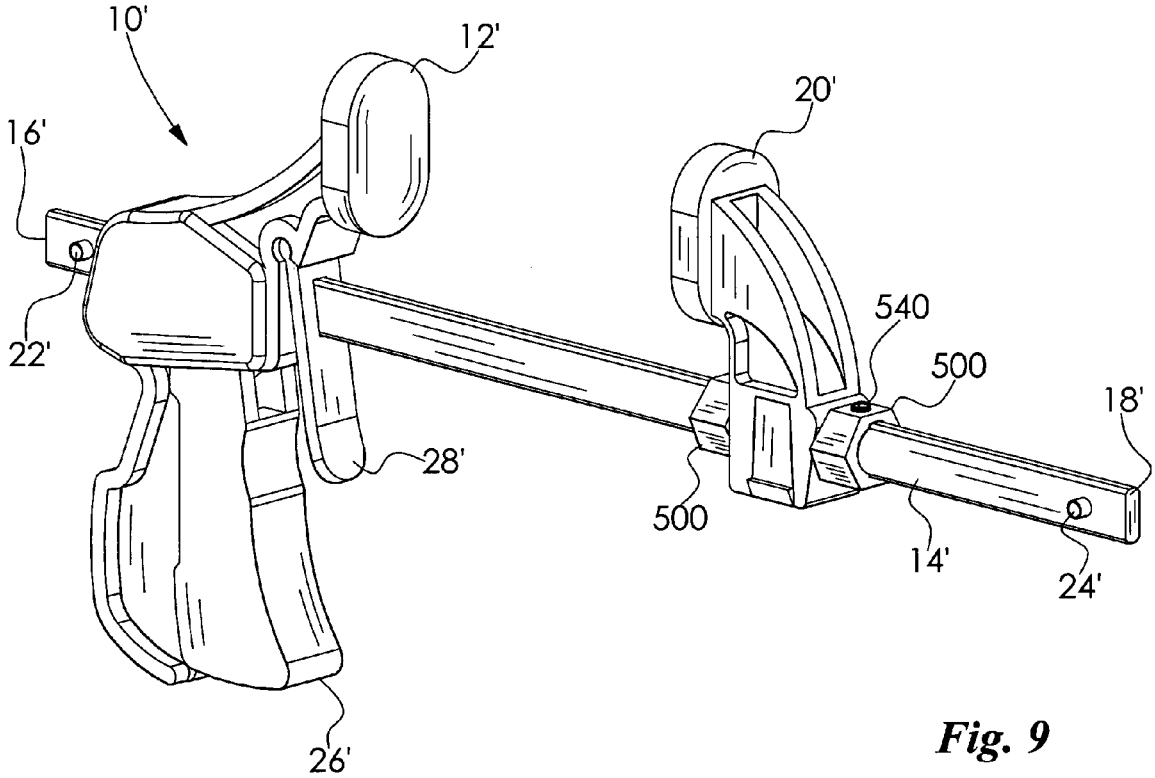
FIG. 9 is a perspective view of the bar clamp with an attached jaw stop.
Figure 10A:
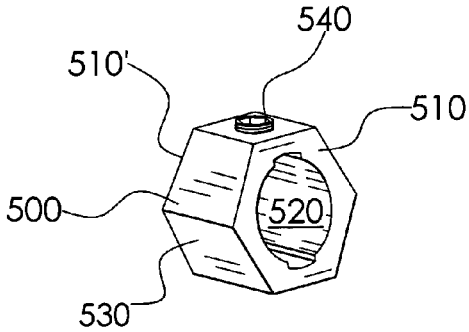
FIG. 10*a* is a perspective view of the jaw stop illustrated in FIG. 9.
Figure 10B:
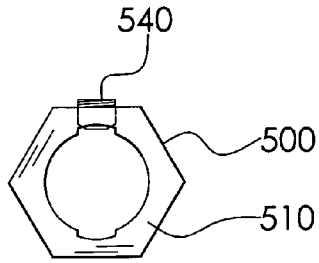
FIG. 10*b* is a transverse view of the jaw stop illustrated in FIG. 9.

FIGS. 9, 10*a*, and 10*b* illustrate a sleeve 500 that may be used in combination with the bar clamp illustrated in FIG. 1 and the bar clamp extensions illustrated in FIGS. 2-8, for example. The sleeve 500 includes opposing ends 510, 510'. The sleeve 500 is hollow with an inner surface 520 and outer surface 530. The inner surface 520 of the sleeve 500 is adapted to slidingly receive a primary bar 14' of the device illustrated in FIG. 9 or an extension bar 44' as illustrated in FIGS. 2 through 8, for example. A set screw 540 may be incorporated in the sleeve 500 to militate against movement thereof.

The prior art bar clamps, as illustrated in FIG. 1, for example provide means for affixing the fixed jaw 20 on the primary bar 14 at one position. The sleeves 500 shown in FIGS. 9, 10*a*, and 10*b* provide a system for selectively positioning the jaw 20 along the length of the primary bar 14'. The jaw 20 may be disposed between two spaced apart sleeves 500 and located at any desired position along the primary bar 14' and then locked.

Figure 11:
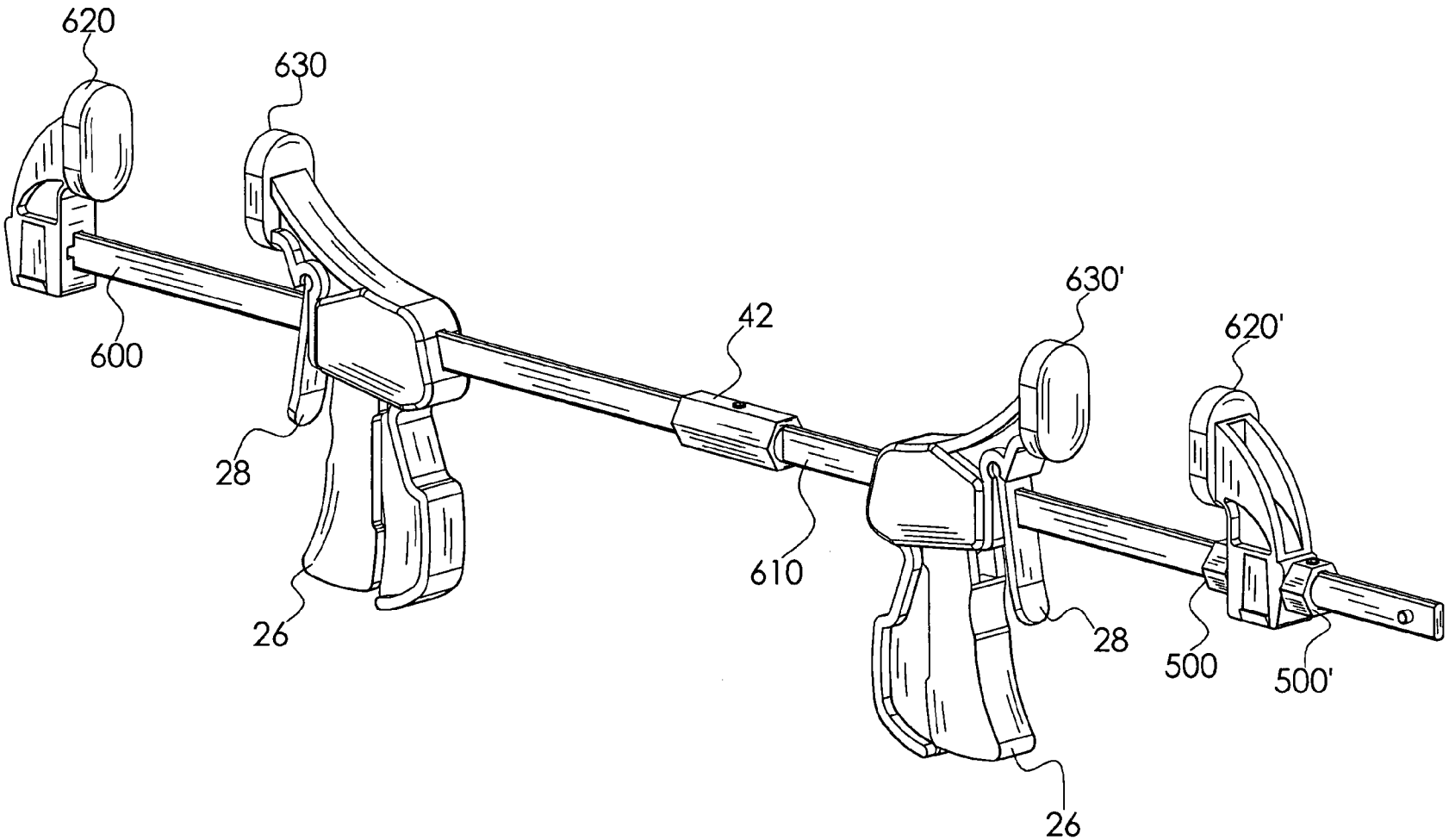
FIG. 11 is a perspective view of a pair of bar clamps utilizing the present invention.

FIG. 11 illustrates an arrangement wherein two primary bars 600, 610 are joined using the coupling 42 shown in FIGS. 2-4. The jaws 620, 620' are fixed at opposite ends of the bars 600, 610. The two moveable jaws 630, 630' are between the fixed jaws 620, 620' and oriented to create a clamping force with the adjacent fixed jaws 620, 620' respectively. The longitudinal distance between the fixed jaws 620, 620' can be adjusted to any desired length by using a pair of the sleeves 500, 500' (as illustrated in FIGS. 10*a* and 10*b*) to lock the jaw 620' along the length of the bar 610.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. In a bar clamp extension for extending the length of a bar clamp assembly which includes a primary bar having a distal end and a proximal end, a releasably mounted jaw on the distal end of the primary bar, a relatively moveable jaw attached to the proximal end section of the primary bar, the improvement comprising:

an extension bar having a proximal end and a distal end; and coupling means at the proximal end of the extension bar for releasably attaching the extension bar to the distal end of the primary bar in longitudinal alignment, the coupling means including a cylindrical body with a proximal end configured to receive the end of the primary bar and a distal end fixed to the proximal end of the extension bar, and a hollow sleeve having a proximal end and a distal end and configured to be slideably received over the cylindrical body surrounding the respective ends of the primary bar and the extension bar received by the body.

2. The bar clamp extension according to claim 1, wherein the sleeve includes means to secure the sleeve in alignment with the body.

3. The bar clamp extension according to claim 2, wherein the extension bar includes at least one notch adjacent to the distal end of the attached body.

4. The bar clamp extension according to claim 2, wherein the means to secure the sleeve is frictionally maintained between the collars and the notches in the extension bar.

5. The bar clamp extension according to claim 1, wherein the sleeve includes spaced apart collars at the distal end depending from an inner surface.

6. The bar clamp extension according to claim 5, wherein the collars include:

slots for receiving the extension bar; and a stop that when in contact with the distal end of the body positions the collar in horizontal alignment with the notches in the extension bar.

7. The bar clamp extension according to claim 1, wherein the extension bar includes external teeth at the proximal end.

8. The bar clamp extension according to claim 7, wherein the sleeve is adapted to receive the body allowing relative rotational movement therebetween.

9. The bar clamp extension according to claim 8, wherein the sleeve is provided with internal threads adapted to threadably engage the external teeth of the extension bar.

10. In a bar clamp assembly with at least one clamp bar having a distal end and a proximal end, a releasably mounted jaw on the distal end of the primary bar, a relatively moveable jaw attached to the proximal end section of the primary bar, the improvement comprising:

a first sleeve and a second sleeve slideably mounted on the clamp bar for securing the fixed jaw at selective locations along the clamp bar.

11. The bar clamp assembly according to claim 10, wherein each sleeve includes means to secure the sleeve at selected positions on the clamp bar.

12. The bar clamp assembly according to claim 11, wherein the means to secure the sleeve includes a set screw.

* * * * *